US006431333B1

(12) United States Patent
Glodich

(10) Patent No.: US 6,431,333 B1
(45) Date of Patent: Aug. 13, 2002

(54) HOCKEY EQUIPMENT CARRYING BAG

(75) Inventor: John Glodich, Canton, MI (US)

(73) Assignee: Stork Athletic Company, Bloomfield Hills, MI (US)

( * ) Notice: Subject to any disclaimer, the term of this patent is extended or adjusted under 35 U.S.C. 154(b) by 3 days.

(21) Appl. No.: 09/608,814

(22) Filed: Jun. 30, 2000

(51) Int. Cl.[7] ..... A45C 3/00
(52) U.S. Cl. ..... 190/110; 150/113
(58) Field of Search ..... 190/110, 107, 190/109, 15 R, 103, 105; 224/542, 539; 220/529, 530, 536, 554; 150/104, 111–117, 123–124

(56) References Cited

U.S. PATENT DOCUMENTS 3,650,588 A * 3/1972 Helland ..... 312/351
4,279,342 A * 7/1981 Van Pelt ..... 206/542
4,506,769 A 3/1985 Franco et al.
4,752,263 A 6/1988 Pritchard et al.
4,923,060 A * 5/1990 Breslau ..... 206/316.2
5,042,664 A * 8/1991 Shyr et al. ..... 206/579
5,090,526 A * 2/1992 Jacober ..... 190/107
5,199,729 A * 4/1993 Sievert et al. ..... 280/47.35
5,447,261 A 9/1995 Mitomi et al.
5,588,529 A 12/1996 Speck
5,588,569 A 12/1996 Mitomi et al.
5,634,576 A 6/1997 Arbel
5,676,286 A 10/1997 Song
D387,198 S 12/1997 Lehmann et al.
5,743,447 A 4/1998 McDermott
5,749,503 A * 5/1998 Wulf et al. ..... 224/153
5,845,780 A 12/1998 Allen
6,095,385 A 8/2000 Utu et al.
6,213,266 B1 * 4/2001 Hollingsworth ..... 190/108

* cited by examiner

*Primary Examiner*—Lee Young
*Assistant Examiner*—Lien Ngo
(74) *Attorney, Agent, or Firm*—Harness, Dickey & Pierce, P.L.C.

(57) ABSTRACT

A hockey equipment bag having an interior compartment comprising a series of adjustable shelves. The equipment bag sits upright and is accessible through a series of closeable flap panels. An inner frame provides a series of holes to accept spring compression crossmembers used to support shelf panels. The shelf panels adjust to configure compartment size as desired by the user. Pockets are incorporated to the sides of the equipment bag for holding specific articles. The equipment bag is partially collapsible and includes straps as well as a handle and wheels to facilitate transportation.

15 Claims, 3 Drawing Sheets

HOCKEY EQUIPMENT CARRYING BAG

BACKGROUND OF THE INVENTION

1. Field of the Invention

The present invention relates generally to activity bags, and more particularly to a vertically standing, partially collapsible, sectionally divided hockey bag.

2. Discussion

Activity bags generally include a body defining an enclosure including a zippered or other recloseable opening intended to receive the articles. In some applications, activity bags include handles, carry straps and rollers for ease of transportation. Often activity bags incorporate sectional compartments for organization.

Hockey players specifically use a large assortment of equipment. A hockey player usually is presented with the task of transporting a large quantity of equipment such as skates, pads, shin guards, helmets, gloves and other items. Often it becomes cumbersome to effectively transport equipment from rink to rink.

A standard hockey bag presents many drawbacks to the travelling hockey player. Many hockey bags are unsectional making it difficult to fill the bag in an organizational fashion. It is sometimes awkward and time consuming to navigate through an unsectional bag to locate a desired article. In addition, it is inconvenient and uncomfortable to continually have to bend over to access a piece of equipment since the bag generally lies flat on the floor.

Hockey players use equipment of many different shapes and sizes. Accordingly, it would be desirable to incorporate an adjustable shelving feature in the inner storage compartment of a hockey bag capable of accepting a variety of equipment. It would also be useful to have a hockey bag that could be configured to have dedicated compartments for specific equipment. Furthermore, it would be desirable to have a hockey bag that stands upright such that the user may access the equipment more easily.

SUMMARY OF THE INVENTION

It is an object of the present invention to provide an upright activity bag with an adjustably sectioned internal compartment including a series of side pockets configured to accept designated pieces of hockey equipment.

It is another object if the present invention to provide an activity bag with an internal frame member adapted to adjustably accept at least one spring compression crossmember.

It is still another object of the present invention to provide at least one closeable flap incorporated for entry into the internal compartment.

It is yet another object of the present invention to provide an activity bag with a set of straps, a handle and a pair of wheels incorporated to facilitate transportation.

Briefly described, the activity bag has an exterior fabric shell supported by an internal frame having a series of separate equipment pockets attached to each side with the cavity of the shell divided by a series of mesh fabric shelves creating a sequence of separate internal storage compartments. The bag may be moved by carrying it with the two shoulder straps, or by rolling it on built in wheels attached to the internal frame of the bag. The internal frame is partially collapsible and comprised of plastic extrusion U-channels. Attached to the U-channels are a series of spring compression crossbars that hold the mesh fabric which creates the internal shelving. The crossbars seat into various holes along the U-channels. The crossmembers are moveable along the holes to customize the size of the internal storage compartments. Foam wall supports are disposed along the side panels on the interior of the bag for added support. The wall supports are made of a foam material and include a series of apertures to encourage air flow through the bag. The storage compartments are accessible through a series of flaps incorporated in the top and front of the bag.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more filly understood from the detailed description and the accompanying drawings, wherein.

DETAILED DESCRIPTION OF THE PREFERRED EMBODIMENT

Figure 1:
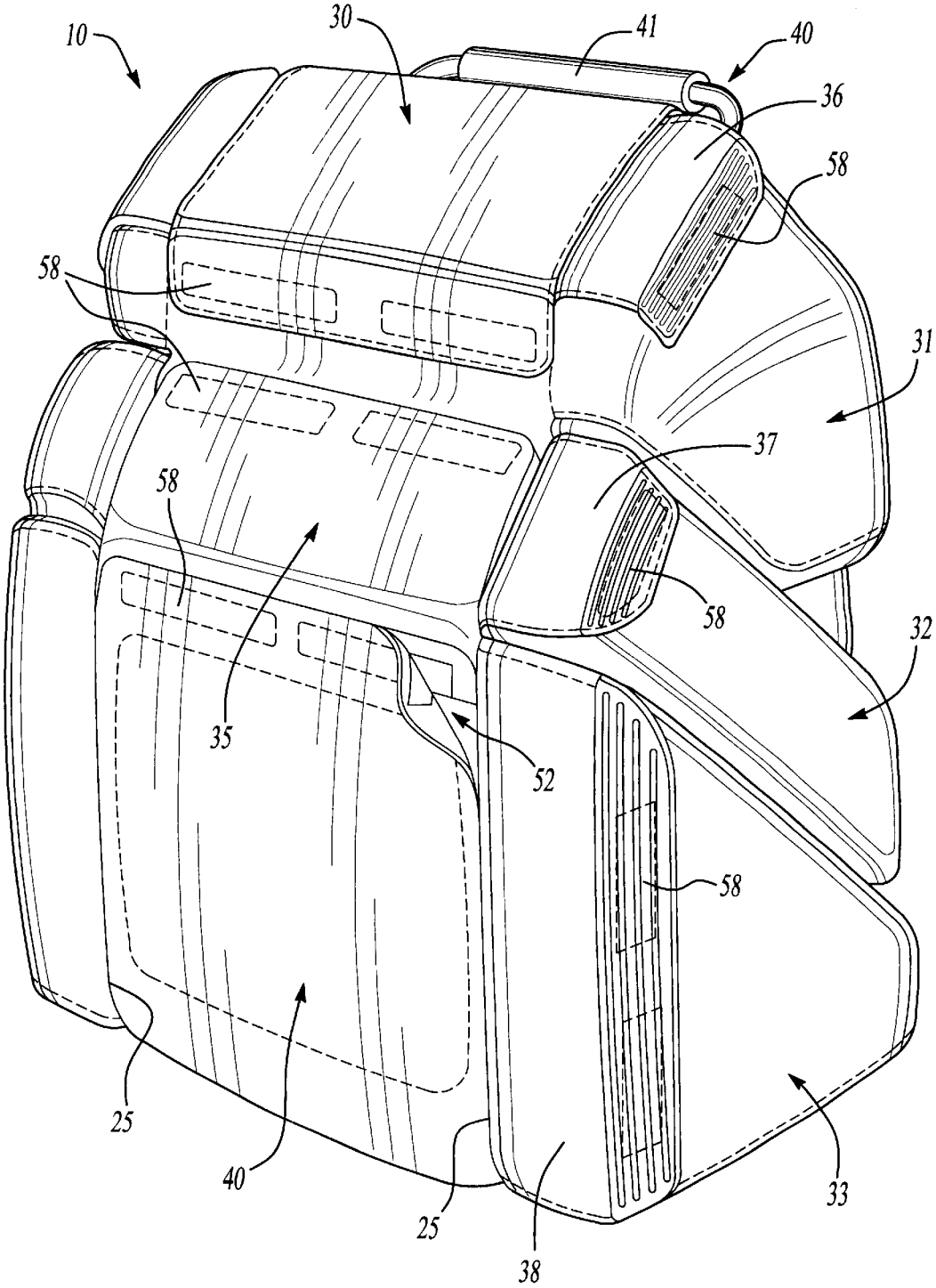
FIG. 1 is a perspective view of the activity bag constructed in accordance to the teachings of the preferred embodiment of the present invention.

The present invention provides an improved activity bag configured to be utilized by a hockey player. With reference to the drawings, the activity bag constructed in accordance with the teachings of the present invention is illustrated and identified with reference numeral 10 as shown in FIG. 1. The external material of the activity bag is made of a flexible mesh fabric that facilitates airflow therethrough. The activity bag consists of an back panel 15, a bottom panel 20, two side panels 25, a top flap 30, a first front flap 35 and a second front flap 40. The side panels 25 extend in a direction perpendicular from the bottom panel 20. Attached to each of the side panels 25 are side pockets 31, 32 and 33. The side pockets 31, 32 and 33 are configured to accept elbow pads, shin guards and hockey skates respectively. The pockets 31, 32 and 33 may also be used to hold other items as needed. The pockets 31, 32 and 33 are accessible through flaps 36, 37 and 38 respectively. The flaps 30, 35, 36, 37, 38 and 40 are selectively secured with Velcro 58 or similar closure device. Flap 40 is shown partially opened to illustrate opening 52 in which the user may gain access therethrough. It will be appreciated that flaps 30, 35, 36, 37 and 38 open similarly to gain access to different portions of the bag 10.

Figure 2:
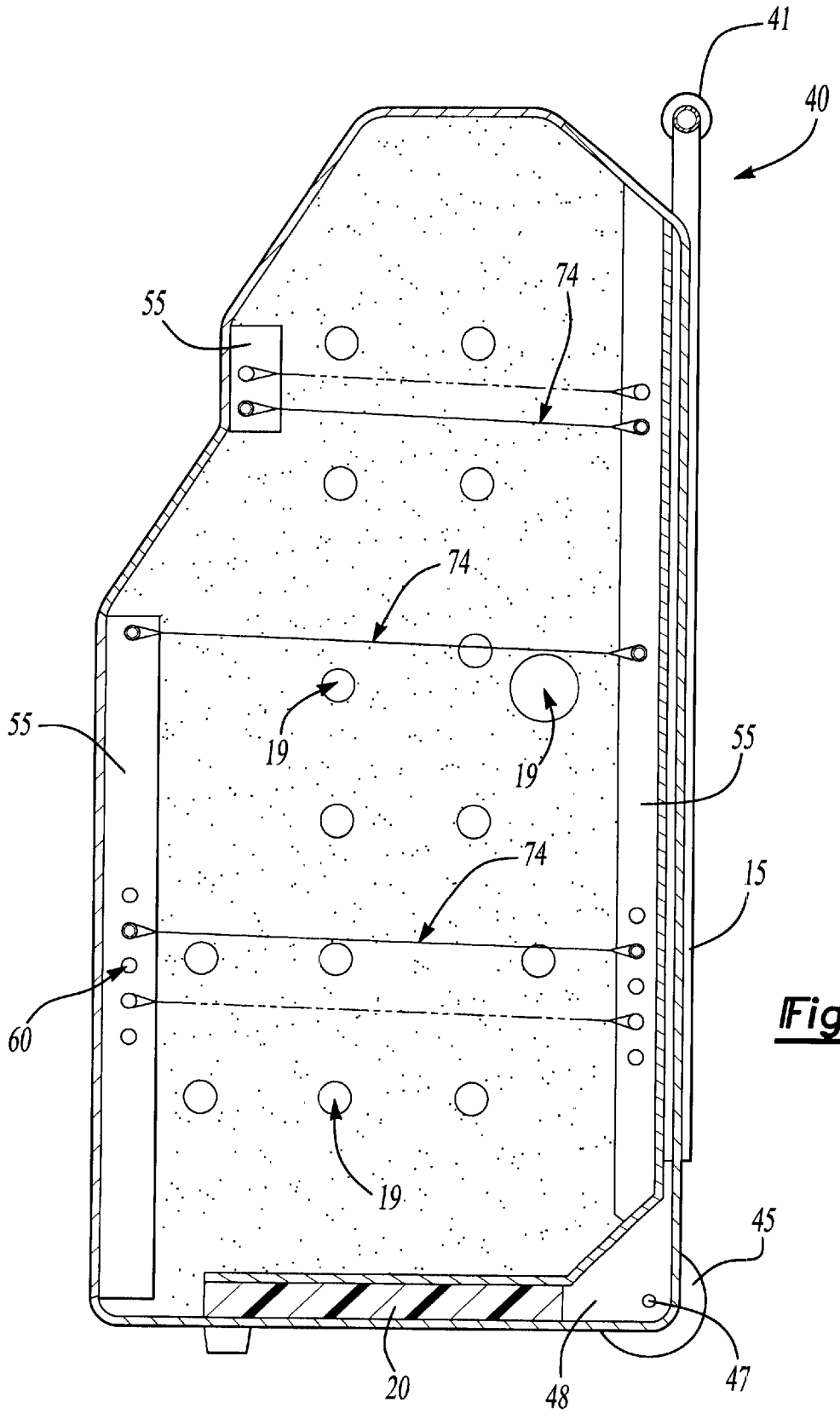
FIG. 2 is a side view of the activity bag with the side panel removed for purposes of illustrating an inner foam panel of the activity bag.

Referring now to FIG. 2, the back panel 15 has a handle 40 suitably attached on an outer surface thereof. The handle 40 has a soft deformable padding 41 disposed therearound for comfort and grip such as foam or the like. A pair of wheels 45 are attached to the bottom panel 20 at the bottom panel 20, back panel 15 intersection. The wheels 45 are recessed toward the internal space 50 of the activity bag 10 and are attached with pins 47 through the bottom frame member 48.

The inner channel members 55 are disposed vertically within the internal space 50. The inner channel members are suitably attached to the side panels 25 by Velcro 27 or the like. The inner channel members 55 include a series of appertures 60 to accept the adjustable shelf crossmembers 62. The adjustable shelf crossmembers 62 include spring compression tabs 70 extending therefrom. The spring compression tabs 70 insert into the apertures 60 of the inner channel members 55. The adjustable shelf crossmembers 62 are wrapped and joined by a shelf 74 consisting of a mesh fabric or suitable equivalent.

Figure 3:
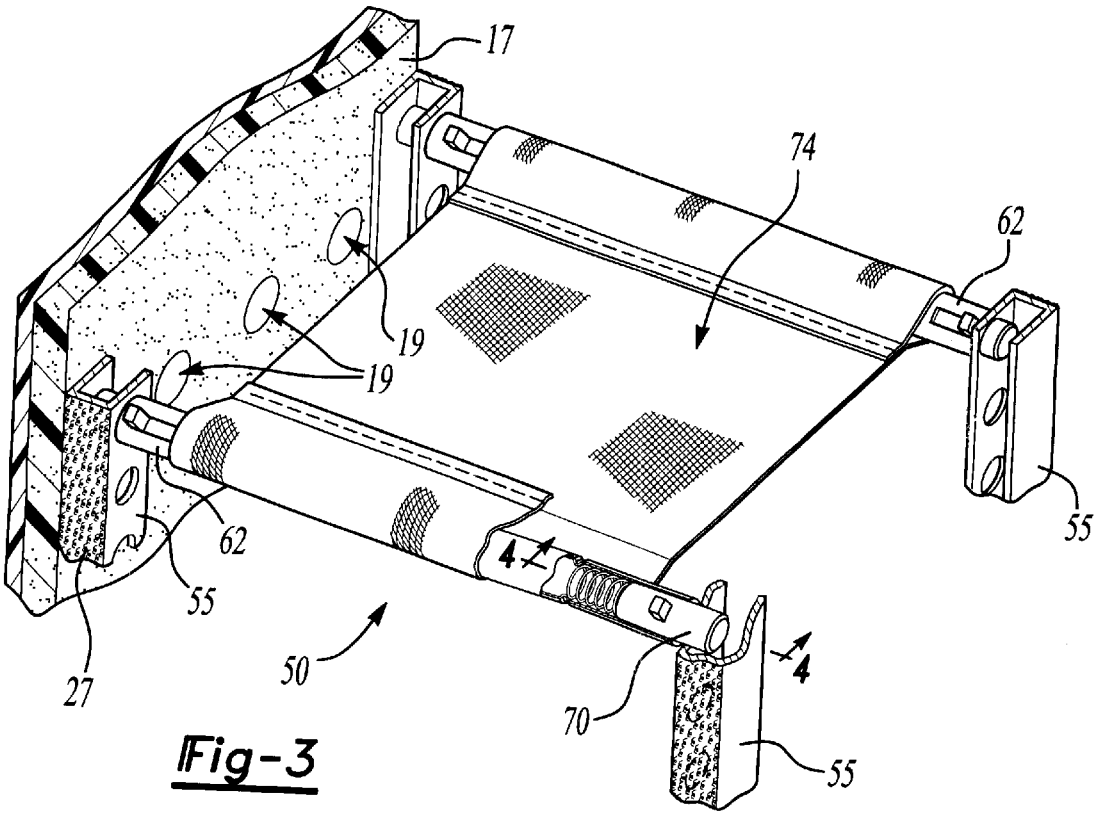
FIG. 3 is a perspective view of a shelf with a portion of the shelf material removed to show a spring compression crossmember.

Referencing now FIG. 3, the activity bag 10 includes two upright walls 17 disposed within the internal space 50 adapted to fit along side panels 25 to provide support. The upright walls 17 are made of lightweight foam material and include a plurality of apertures 19 which encourage air flow through the internal space 50.

Figure 4:
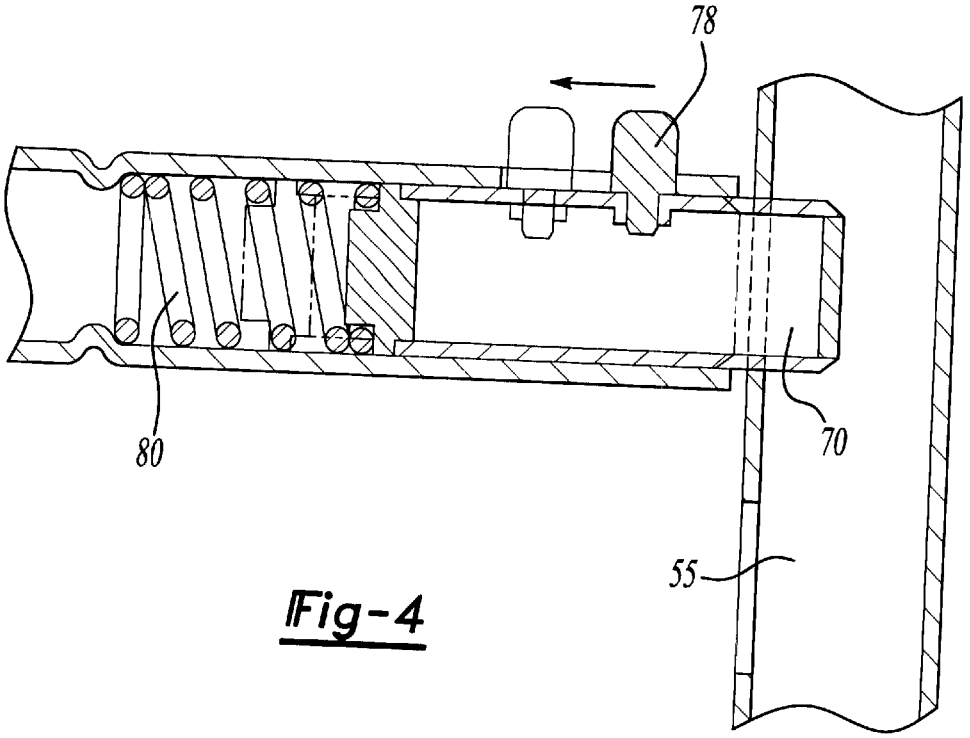
FIG. 4 is a cross-sectional view of a spring compression crossmember taken along line 4—4 of FIG. 3.

Turning now to FIG. 4, the spring compression tabs 70 may be retracted by applying a force to the slide tab 78. The force from the spring compression tabs 70 compress an inner spring 80 allowing the spring compression tabs 70 to disengage the apertures 60. Accordingly, the shelves 74 may be moved higher or lower to accommodate desired articles within the internal space 50 of the activity bag 10.

While this invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention.

What is claimed is:

1. An activity bag comprising:

a back panel having a plurality of edges;

a bottom panel having a plurality of edges, wherein one of the plurality of bottom panel edges attaches to one of the plurality of back panel edges;

first and second side panels having a plurality of edges, wherein one of the plurality of first and second side panel edges attaches to one of plurality of back panel edges and one of plurality of bottom panel edges;

a front panel, the front panel having an opening;

a flap for covering the opening;

wherein the panels form a shaped inner body cavity defining an internal space and an external shell, the opening enabling access to the internal space;

channel members disposed within the interior of the internal space, the channel members defining an inner frame, the inner frame supporting the inner body cavity; and at least one spring compression crossmember adjustably secured between selected channel members defining at least one substantially horizontal shelf.

2. The activity bag according to claim 1 wherein the front flap includes a fastener to allow the front flap to be partially openable.

3. The activity bag according to claim 2 wherein the selected channel members include a plurality of opposing apertures for receiving the spring compression crossmember.

4. The activity bag according to claim 3 wherein the side panels are supported by upright foam walls disposed within the internal space.

5. The activity bag according to claim 4 wherein said foam walls include a plurality of apertures integrated therethrough.

6. The activity bag according to claim 1 wherein the external shell includes first and second wheels attached thereto.

7. The activity bag according to claim 1 wherein the external shell includes a handle member attached thereto.

8. The activity bag according to claim 1 wherein the activity bag includes straps attached thereto.

9. The activity bag according to claim 1 wherein the side panels include at least one pocket attached thereto.

10. An activity bag comprising:

a box member including a bottom panel;

first and second side panels;

back panel adjoining the first and second side panels extending from an outer periphery of the bottom panel;

a top closure panel;

an at least one front closure panel;

a shelf panel including spring actuated tab members; and channel members disposed adjacent the first and second side panels defining an inner frame member including a plurality of apertures, the plurality of apertures configured to adjustably accept the shelf panel tab members.

11. The activity bag according to claim 10 wherein the bottom panel includes first and second wheels attached thereto.

12. The activity bag according to claim 10 wherein the back panel includes a handle attached thereto.

13. The activity bag according to claim 10 wherein the activity bag includes straps attached thereto.

14. The activity bag according to claim 10 wherein the side panels include at least one pocket attached thereto.

15. An activity bag comprising:

a back panel having a plurality of edges;

a bottom panel having a plurality of edges, wherein one of the plurality of bottom panel edges attaches to one of the plurality of back panel edges;

first and second side panels having a plurality of edges, wherein one of the plurality of first and second side panel edges attaches to one of plurality of back panel edges and one of plurality of bottom panel edges;

a front panel, the front panel having an opening;

a flap for covering the opening;

wherein the panels form a shaped inner body cavity defining an internal space and an external shell, the opening enabling access to the internal space;

channel members having opposing portions disposed generally upright within the interior of the internal space, the channel members defining an inner frame, the inner frame supporting the inner body cavity;

at least one spring compression crossmember adjustably secured between selected channel members defining at least one substantially horizontal shelf; and the inner frame further comprising upright foam walls disposed within the internal space.

* * * * *